United States Patent [19]

Carder

[11] Patent Number: 4,653,138

[45] Date of Patent: Mar. 31, 1987

[54] CARPET FASTENING METHOD AND MEANS

[76] Inventor: William E. Carder, 26 Sandle St., Fairport, N.Y. 14450

[21] Appl. No.: 784,316

[22] Filed: Oct. 4, 1985

[51] Int. Cl.[4] ..... A47G 27/04

[52] U.S. Cl. ..... 16/4; 16/1 R; 16/7; 16/16

[58] Field of Search ..... 16/4, 1 R, 5, 6, 7, 16/16

[56] References Cited

U.S. PATENT DOCUMENTS

| | | | |
|---|---|---|---|
| 1,576,527 | 3/1926 | McBride | 16/16 |
| 2,449,904 | 9/1948 | Lorraine | 16/7 |
| 2,563,615 | 8/1951 | Paul | 16/16 |
| 3,805,862 | 4/1974 | Jirovetz | 16/4 |

FOREIGN PATENT DOCUMENTS

| | | | |
|---|---|---|---|
| 2249392 | 4/1974 | Fed. Rep. of Germany | 16/6 |

*Primary Examiner*—Leonidas Vlachos

*Attorney, Agent, or Firm*—Shlesinger, Fitzsimmons, Shlesinger

[57] ABSTRACT

A plurality of special metal clips is used to secure a wooden, carpet securing strip to a floor, and to retain a conventional threshold insert over the strip and the edge of any carpeting that is secured to the strip. Each clip has an upright, generally U-shaped section which extends along one side of the wooden strip (the side remote from the carpet), and which registers longitudinally with the other U-shaped sections of the remaining clips. These registering U-shaped sections of the clips are adapted to accommodate and frictionally to house the mounting rib of a conventional, elongate threshold insert, which is thus fastened by its rib to the clips so as to be held thereby in covering relation with the strip and the adjacent edge of the installed carpet, thereby to prevent accidental tripping over the carpet edge and any consequent damage thereto.

11 Claims, 6 Drawing Figures

CARPET FASTENING METHOD AND MEANS

BACKGROUND OF THE INVENTION

This invention relates to a novel method and associated means for installing carpeting, and in particular this invention relates to an improved method for readily securing the edges of rugs, carpets, and the like to a floor, and in such manner that the exposed edges of the carpet are covered to prevent accidents and damage to the carpet.

It has long been customary to employ elongate, rigid metal strips for securing the edges of wall-to-wall carpeting and the like to a wooden floor. Typically such strips includes a first longitudinally extending section having therein a plurality of spaced apertures for accommodating nails that are used for securing the strip to the floor. Integral with, and usually slightly offset from the first section of the strip is a carpet-gripping section having formed therealong a plurality of spaced, pointed projections, which are designed to engage and project into the underside of the carpeting along the edge thereof which is to be secured to the floor. In some instances these projections are in the form of a plurality of saw-tooth shaped teeth spaced along one edge of the carpet-gripping section of the strip, as shown for example in applicant's U.S. Pat. No. 4,069,542, as well as in U.S. Pat. Nos. 2,051,191 and 2,611,918. Other forms of strips employ sharp, triangularly shaped teeth that are struck up from the surface of the carpet-gripping section of the strip, as taught for example by U.S. Pat. Nos. 2,554,674, 3,008,173 and 2,733,475.

As an alternative to metal carpet securing strips, it has been customary also to employ elongate wooden strips which are secured by nails or the like to the floor, and which have projecting from their upper surfaces pointed ends of a plurality of spaced nails that are driven into the board at angles inclined to its upper and lower surfaces, as shown for example in U.S. Pat. Nos. 2,677,145 and 3,670,360.

In more recent years it has become customary to employ extruded metal carpet strips of the type that generally are sold in elongate, twelve foot lengths, which makes them very difficult to ship and to handle. Moreover, these extruded strips are usually provided also with an elongate groove, which opens on the upper surface of the strip along one edge thereof to accommodate a rubber or plastic threshold insert or overlay. This type of carpet securing strip is frequently employed in those instances in which carpeting does not cover the entire surface of a floor, in which case the carpet projects, along at least one edge thereof, slightly above the uncarpeted portion of the floor. The above-noted insert or overlay is therefore secured along an edge of the metal carpet securing strip in such manner that it povides a bevelled or inclined, ramp-type surface between the edge of the metal strip and the uncarpeted portion of the floor. Modified forms of these overlays are also employed in cases where the metal carpet securing strips are designed to form a junction between two separate, but adjacent layers of installed carpeting.

In addition to being relatively expensive, one of the primary disadvantages of extruded carpet securing strips of the type described is that they are produced in such lengths that it makes it very difficult to ship and to handle the strips. Also, they obviously are more difficult to trim as compared to the old fashioned wooden carpet securing strips, since they require, among other things, the use of a metal cutting saw.

It is an object of this invention, therefore, to provide an improved, relatively simple and inexpensive method for installing carpeting, and in particular carpeting of the type which covers only a portion of a floor surface, or which terminates at a doorway or the like.

Still another object of this invention is to provide an improved method of installing carpeting which will obviate the need for employing elongate strips of metal for securing the edge of a carpet in place, and which, therefore, considerably reduces the cost of installing such carpeting.

It is an object also of this invention to provide improved clips, which are specifically designed for use in connection with conventional threshold inserts or overlays heretofore employed with extruded metal carpet securing strips.

Other objects of the invention will be apparent hereinafter from the specification and from the recital of the appended claims, particularly when read in conjunction with the accompanying drawing.

SUMMARY OF THE INVENTION

Instead of using extruded metal strips, wooden carpet securing strips of the so-called tackless variety are secured to a floor along the edge of the carpet that is to be installed, and with the pointed ends of its projections facing upwardly to be embedded in the usual manner in the underside of the carpet that is being installed. A plurality of similar, short, metal clips are then secured to the wooden strip at longitudinally spaced points therealong. Each metal clip has an upright, generally U-shaped section which extends beyond the outer side of the wooden strip (the side remote from the carpet), and which registers longitudinally with the other U-shaped sections of the remaining metal clips that are secured to the wooden strip. These registering U-shaped sections are adapted to accommodate and frictionally to house the mounting rib of a conventional, elongate threshold insert, which is thus fastened by its rib to the several (or plural) metal clips to be held thereby in overlapping relation to the adjacent edge of the installed carpet thus to protect the edge and to prevent accidental tripping over the carpet edge.

THE DRAWING

DETAILED DESCRIPTION OF THE PREFERRED EMBODIMENTS

Figure 1:
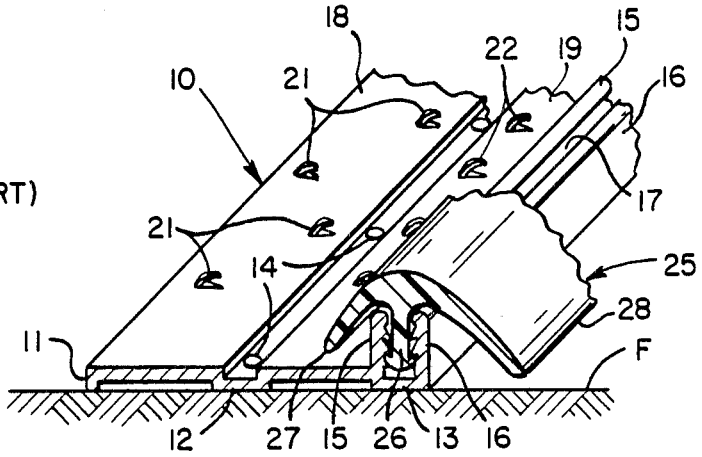
FIG. 1 (PRIOR ART)
FIGS. 1 and 1A are a fragmentary perspective views, partially in section, showing conventional metal carpet securing strips and associated threshold inserts of the type commonly employed therewith for installing carpeting on a floor.

Referring now to the drawing by numerals of reference, and first to the prior art shown in FIG. 1, 10 denotes generally a tackless-type carpet securing strip made from extruded aluminum or the like. Strip 10 has three, spaced, longitudinally extending rib sections 11, 12 and 13, which are disposed to have the undersides thereof seated in coplanar relation on the surface of the floor F, or the like, to which the associated carpeting is to be secured. The rib section 12 has therethrough a plurality of spaced openings 14 for accommodating the shanks of nails or screws, which can be employed for securing the strip 10 to the floor F. Rib section 13 has integral therewith two, spaced, parallel, upstanding wall sections 15 and 16, which extend longitudinally of strip 10 to form along one edge thereof a deep, longitudinally extending, generally U-shaped groove 17 for accommodating the rib of a threshold insert or overlay as described hereinafter. Between the rib sections 11 and 12 strip 10 has formed thereon a plane, horizontally disposed carpet supporting section 18, which registers with a similar surface 19 formed on the strip between rib 12 and the upstanding wall section 15. Each of the carpet supporting surfaces 18 and 19 has struck upwardly therefrom a plurality of spaced carpet-engaging teeth or projections 21 and 22, respectively.

In use, after the strip 10 has been secured in place on a floor F adjacent one edge of a mat M, the edge of the carpet (not illustrated) which is to being installed is positioned over the supporting surfaces 18, 19 so that its edge terminates against the upstanding wall section 15, and so that the points of projections 21, 22 become embedded in the underside of the carpet to retain it in place. Thereafter an elongate threshold insert or overlay 25, which has approximately centrally thereof an integral, downwardly projecting, barbed rib 26, is fixed to the strip 10 by inserting its rib 26 downwardly between the confronting surfaces of the wall sections 15 and 16 of the U-shaped section of the strip, so that the opposed, longitudinal side edges 27 and 28 of the insert overlie the upper edges of the wall sections 15 and 16 to extend downwardly therefrom as that edge 27 will overlap the edge of the carpet facing section 15, and so that edge 28 will extend down to floor F.

Figure 1A:
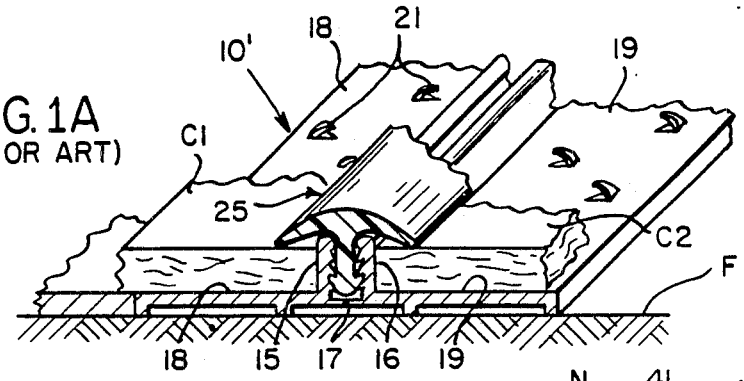
FIG. 1A (PRIOR ART)

In FIG. 1A, 10' denotes a modified form of this carpet securing strip wherein the upstanding walls 15 and 16, which form the insert-accomodating groove 17, are positioned centrally of the strip so that the two carpet supporting surfaces 18 and 19 are formed on opposite sides, respectively of the walls 15,16. As in the preceeding embodiment each of the surfaces 18 and 19 has struck upwardly therefrom a plurality of pointed projections 21 and 22, which face in the direction of the walls 15 and 16, respectively.

In use, the edges of two separate carpet sections C1 and C2 are positioned over the surfaces 18 and 19, respectively, to be engaged by the associated carpet securing pins 21 and 22. The edges of these carpet sections are positioned against the outer surfaces of the wall sections 15 and 16, so that when a threshold insert 25 is secured to the strip by inserting its rib section 26 into the space between the wall sections 15 and 16, opposite edges of the insert will overlie the adjacent edges of carpet sections C1 and C2, respectively.

These known systems of securing carpet edges as illustrated and described in connection with FIGS. 1 and 1A utilize the elongate, metal strips 10 and 10' which, as noted above, usually are marketed in twelve foot lengths.

Figure 2:
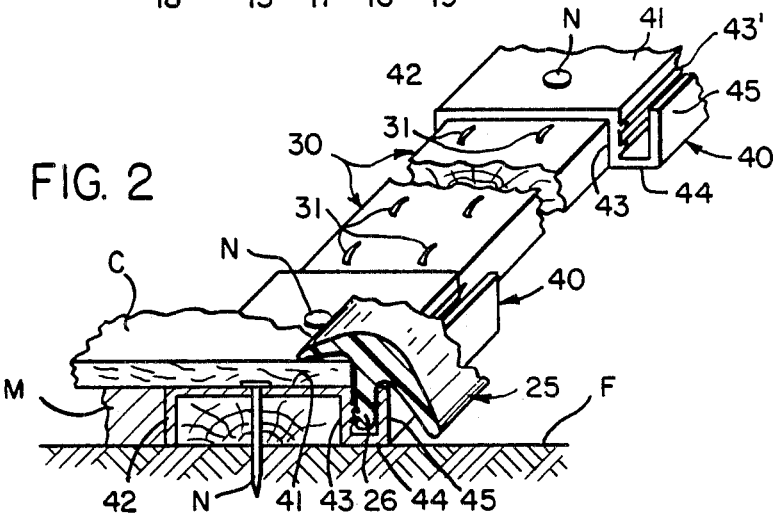
FIG. 2 is a fragmentary perspective view generally similar to FIG. 1, but illustrating an improved method of installing carpeting on a floor by employing wooden carpet securing strips and novel insert or overlay retaining clips therewith.

Referring now to FIG. 2, 30 denotes generally a conventional, wooden, carpet securing board or strip of the type in which a plurality of nails are inserted through one side of the board (the underside in FIG. 2), so that the opposite, pointed ends thereof project as of 31 beyond the opposite or upper surface of the strip, and at an angle inclined slightly to the upper surface of the strip. Moreover, the projecting ends of the nails 31 are all inclined in the same direction, or generally toward the right as shown in FIG. 2.

In use, for securing a carpet edge in place, one of the wooden strips 30 is secured by nails N to the surface floor F in the usual manner. Also, at spaced points along its length strip 30 has secured thereto two or more, novel, insert-retaining clips which are denoted generally at 40 in FIG. 2. Each clip 40 comprises a flat, planar central section 41 which, when in use, is adapted to overlie a plane, flat surface on the upper side of a strip 30—i.e., a flat surface which does not have any projections 31 extending upwardly therefrom. Integral with and projecting downwardly from the longitudinal side edge of the center section 41 are two, spaced, parallel leg sections 42 and 43, whch are equal in height to the height of a strip 30, and which are adapted to overlie the longitudinal side edges of such a strip, when placed in use as shown in FIG. 2. A further, plane section 44 of each clip 40 is integral along one edge with the lower edge of the clip section 43 and projects at right angles therefrom parallel to the central section 41 of the clip. Remote from the leg section 43 each clip 40 has a further, upright, planar section 45, which is integral at its lower edge with the edge of section 44 remote from the leg 43. The clip section 45 is disposed in spaced, parallel relation to the clip section 43; and its upper edge registers with the upper surface of the central section 41 of the associated clip. In essence, sections 43,44 and 45 form on each clip 40 an integral, generally U-shaped receptacle for accommodating the rib 26 of an insert 25.

When used as shown in FIG. 2, the clips 40 are secured to the strip 30 by one or more nails N, which extend through one or more registering openings in each clip 40, and through the underlying strip 30 and into the floor F. These nails therefore function to secure both the clips 40 and the strip 30 to the floor; and also operate to maintain the U-shaped sections of the clips 40 in longitudinal registry with each other. After strip 30 and clips 40 have been secured in place, the edge of the carpet which is to be installed is positioned to overlie the upper surface of strip 30 and the central sections 41 of the clips 40, and in such a manner that the projections 31 hold the edge of the carpet in approximate registry with the edge of each clip section 41 from which the U-shaped section 43,44, 45 projects. When the carpet C has been secured in place, the rib 26 of a conventional threshold overlay 25 is then inserted into the space between the clip sections 43,45, and in such manner that a portion of the overlay 25 along one side thereof overlies the terminal edge of the carpet C, and the other edge of the overlay is inclined downwardly to engage the floor F and to form an inclined surface, which covers the adjacent sidewall of the strip 30 and the sections 45 of the clips.

The advantage of an installation of this type is that it obviates the need for using the extruded strips 10, and utilizes in place thereof the more inexpensive wood strips 30 in combination with a plurality of small, inexpensive clips 40, which function to secure the associated overlay 25 along one edge of the strip 30, and which also lend additional rigidity to the strip 30, depending upon the spacing between the clips 40. In other words, where the tension on the carpet is extremely heavy, it may be necessary to place the clips 40 closer together then would be the case where such tension is not so extreme. The improved method as shown in FIG. 2, therefore, is substantially more inexpensive than the method as illustrated in FIG. 1, and yet is equally as reliable.

Figure 3:
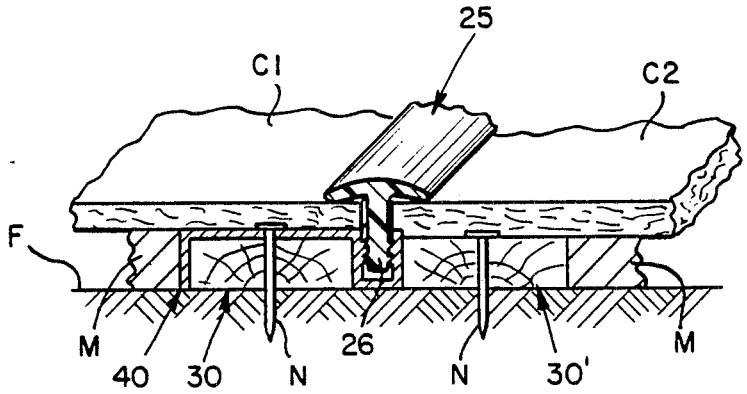
FIGS. 3 & 4 are fragmentary perspective views illustrating still other ways in which these novel insert retaining clips can be employed for installing carpeting.

The novel clips 40 can also be employed in a combination with two conventional wood strips 30 and 30' for the purpose of securing a conventional overlay 25 at the junction between two different carpet strips C1 and C2, as shown for example in FIG. 3. In this system, a second strip 30' is secured to the floor F without any clips 40 thereon, but immediately adjacent to the leg sections 45 of the clips 40 on the first strip 30, so that the same set of clips 40 operate in conjunction with both strips 30 and 30'. In this embodiment, instead of one side of the overlay 25 being inclined downwardly to engage an uncarpeted section of the floor F as shown in FIG. 2, this section of the floor F is now carpeted with a strip of carpet C2, one edge of which overlies, and is secured to, the upper surface of the second wood strip 30'. The clips 40 are positioned to overlie the strip 30 in such manner that their U-shaped projections are positioned in a space formed between the confronting edges of the strips 30, 30' and the carpet sections C1 and C2. The carpet edges are then covered by the overlay 25, the rib 26 of which is secured in the registering spaces formed by the U-shaped sections of the clips 40. In this way opposite edges of the overlay 25 overlie the edges of the adjacent carpet sections C1 and C2, thus protecting these edges, and also avoiding the likelihood of anyone tripping on the edges.

Figure 4:
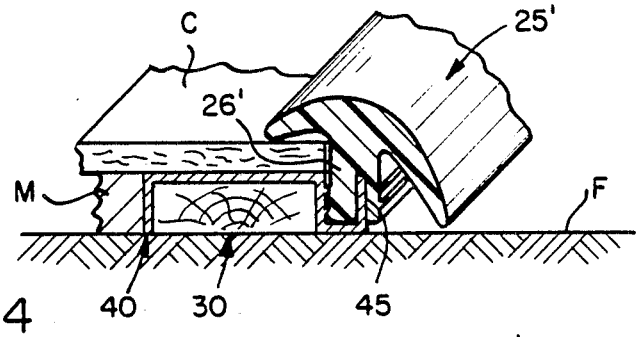

In the embodiment shown in FIG. 4, the clips 40 are used in combination with a wooden strip 30 in much the same manner as shown in FIG. 2, except that in this embodiment the rib 26' of the overlay 25' is provided at its lower end with a longitudinally extending groove or slot for accommodating the leg sections 45 of the registering clips 40. Otherwise the method of securing the carpet is similar to that as shown in FIG. 2.

Figure 5:
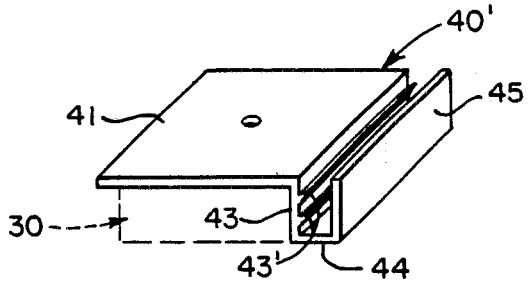
FIG. 5 is a perspective view of a modified form of this clip.

FIG. 5 illustrates a modified clip 40', which is identical to the clip 40 except tht the leg section 42 thereof has been eliminated. Also more evident in this figure are the longitudinally extending ribs 43', which are formed on the surface of the wall section 43 to confront similar ribs (not illustrated) formed on the confronting wall section 45 of the clip. Preferably, similar such spaced ribs are formed also on the confronting surfaces of the clip sections 43 and 45 of clips 40.

While this invention has been illustrated and described in detail in connection with only certain embodiments thereof it will be understood that it is capable of further modifications, and that this application is intended to cover any such modifications as may fall within the scope of one skilled in the art or the appended claims.

I claim:

1. A method of installing carpeting of the type in which at lest one edge thereof is secured to a floor by tackless carpet securing strips, and is covered by an elongate threshold insert of the type having a curved upper section and an integral, downwardly projecting rib comprising positioning a wooden, tackless carpet securing strip on a floor with carpet engaging projections thereon facing upwardly, providing a plurality of rigid clips each having an upright, generally U-shaped section, and a generally flat, planar section integral with and projecting laterally from the upper end of one of the legs defining said U-shaped section, placing a plurality of said clips on said strip at longitudinally spaced points therealong with said planar sections of the clips overlying the upper surface of said strip, and with the U-shaped sections of said clips overlying one side of said strip in registry with each other, securing said clips and said strip to said floor, securing an edge of a section of carpet to the projections on said strips, and securing an elongate threshold insert over said strip by inserting the rib section thereon into the registering spaces defined by said U-shaped sections of said clips, whereby said rib section is secured frictionally between the legs of said U-shaped sections to support the curved upper section of the insert in overlapping relation to said edge of said carpet section.

2. A method as defined in claim 1, including securing a second wooden, tackless carpet securing strip on said floor in spaced, parallel relation to the first-named strip, and immediately adjacent to said U-shaped sections of said clips on said first-named strip, securing an edge of a second section of carpeting to the projections on said second strip, and securing the rib section of said insert in said spaces defined by said U-shaped sections so that said upper section of said insert overlaps at opposite sides thereof, respectively, the edges of said carpet sections secured to said strips.

3. A method as defined in claim 1, wherein the step of securing said strip and said clips to the floor includes nailing or screwing the clips to the strip with nails or screws the shanks of which extend through the clips and the strip into the floor.

4. A carpet fastening device for securing carpeting to a floor or the like comprising, in combination, a wooden, tackless carpet securing strip having a plurality of carpet engaging pins projecting from the upper surface thereof, a plurality of threshold retaining clips mounted on said strip at longitudinally spaced points therealong, each of said clips having an upright, generally U-shaped section overlying one side of said strip, and a flat, planar section overlying the upper surface of said strip, and means securing said clips to said strip and said strip to a floor with said U-shaped sections of the clips aligned in registry with each other along said one side of said strip.

5. A carpet fastening device as defined in claim 4, including a second wooden, tackless carpet securing strip secured to said floor parallel and immediately adjacent to said U-shaped sections of said clips at the sides thereof remote from the first-named strip.

6. A carpet fastening device as defined in claim 4, wherein said securing means comprises a plurality of nails and/or screws extending through the flat sections of each of said clips, and the underlying wooden strips and into said floor.

7. A carpet fastening device as defined in claim 4, wherein each of the confronting surfaces on each of said U-shaped sections of said clips have formed thereon a plurality of spaced ribs which extend parallel to said strip.

8. In combination with a carpet, a tackless strip securing one edge of the carpet to a floor, and a threshold insert covering the carpet edge and strip, the improvement comprising a plurality of like, rigid clips secured to said strip in registry with each other beneath said one edge of the carpet at longitudinally spaced points along the strip, each of said clips having a generally U-shaped section extending along one side of said strip, and an integral, generally flat, planar section projecting laterally from one of two legs of said U-shaped section and overlying the upper surface of said strip beneath said carpet, and said insert having thereon an elongate, centrally disposed rib secured in and extending through the registering spaces formed by said U-shaped sections of the clips, whereby said clips support said insert in covering relation to said one edge of said carpet and said strip.

9. The combination as defined in claim 8, including a second tackless strip secured on said floor adjacent the sides of said U-shaped sections of said clips remote from the first-named strip, and beneath the edge of a second carpet which overlies said second strip in spaced, confronting relation to the edge of the first-named carpet, said insert being supported by said clips so that opposite sides, respectively, of said insert overlap and cover the confronting edges of said carpets.

10. A threshold retaining clip for securing a threshold insert over the edge of carpeting or the like, when the latter is secured on a floor, comprising a rigid, metal clip having an upright, generally U-shaped section, and an integral, generally flat, planar section projecting laterally from the upper end of one of the two legs defining said U-shaped section, and disposed to overlie the upper surface of a tackless strip of the type used for securing the edge of a carpet to a floor, said two legs having on the confronting surfaces thereof a plurality of spaced ribs disposed to engage and frictionally to retain between said legs the mounting rib of a conventional threshold insert.

11. A threshold retaining clip as defined in claim 10, including a further, generally flat, planar section integral with and projecting downwardly from the edge of the first-named planar section remote from said U-shaped section, and parallel to the legs of said U-shaped section.

* * * * *